United States Patent [19]

Vollrath

[11] Patent Number: 5,075,901

[45] Date of Patent: Dec. 31, 1991

[54] ATHLETIC SHIRT-TOWEL ASSEMBLY

[76] Inventor: Victor J. Vollrath, 7980 N. Pennsylvania St., Indianapolis, Ind. 46240

[21] Appl. No.: 682,130

[22] Filed: Apr. 8, 1991

[51] Int. Cl.[5] ..... A41B 1/00

[52] U.S. Cl. ..... 2/115; 2/77; 2/113; 2/114; 2/DIG. 7

[58] Field of Search ..... 2/115, 77, 113, 114, 2/DIG. 7

[56] References Cited

U.S. PATENT DOCUMENTS

| | | | |
|---|---|---|---|
| 3,045,245 | 7/1962 | Kohen | 2/243 |
| 3,174,156 | 3/1965 | Dale et al. | 2/115 |
| 4,050,099 | 9/1977 | David | 2/46 |
| 4,603,440 | 8/1986 | Hale | 2/115 |
| 4,768,236 | 9/1988 | Klob | 2/227 |

FOREIGN PATENT DOCUMENTS

| | | | |
|---|---|---|---|
| 3623583 | 1/1988 | Fed. Rep. of Germany | 2/115 |

*Primary Examiner*—Werner H. Schroeder
*Assistant Examiner*—Gloria Hale
*Attorney, Agent, or Firm*—Woodard, Emhardt, Naughton, Moriarty & McNett

[57] ABSTRACT

An athletic shirt made of relatively non-absorbent synthetic material has a member of highly absorbent material secured thereto around the front of the neck opening and normally disposed inside the shirt and easily pulled up with the shirt in one version, or out of the neck opening in another version, to facilitate wiping perspiration from the face of the wearer.

10 Claims, 4 Drawing Sheets

ATHLETIC SHIRT-TOWEL ASSEMBLY

BACKGROUND OF THE INVENTION

1. Field of the Invention

This invention relates generally to athletic attire, and more particularly to an athletic shirt of a light weight type with perspiration absorbing features.

2. Description of the Prior Art

Prior art shirts used by athletes in indoor team sports, very often have decorative coloring and lettering, numbers and logos. It is desirable that they be durable, have good color retention, and withstand repeated wearings and washing. Also, it is desirable that they not be too heavy or bulky. Most materials found suitable for such purposes employ man-made fibers as a significant component. Consequently, they are not particularly absorbent. Nevertheless, they are used by some perspiring athletes in efforts to wipe perspiration from the face. Since they are not particularly absorbent, they are comparatively ineffective for that purpose. My invention is intended to address the need of athletes for a quick and convenient and effective way to wipe perspiration from the face.

SUMMARY OF THE INVENTION

Described briefly, according to a typical embodiment of the present invention, an athletic shirt has a member of highly absorbent material secured thereto around the front of the neck opening and normally disposed inside the shirt, and easily pulled up to facilitate wiping the face without being separated from the shirt.

DESCRIPTION OF THE PREFERRED EMBODIMENT

Figure 1:
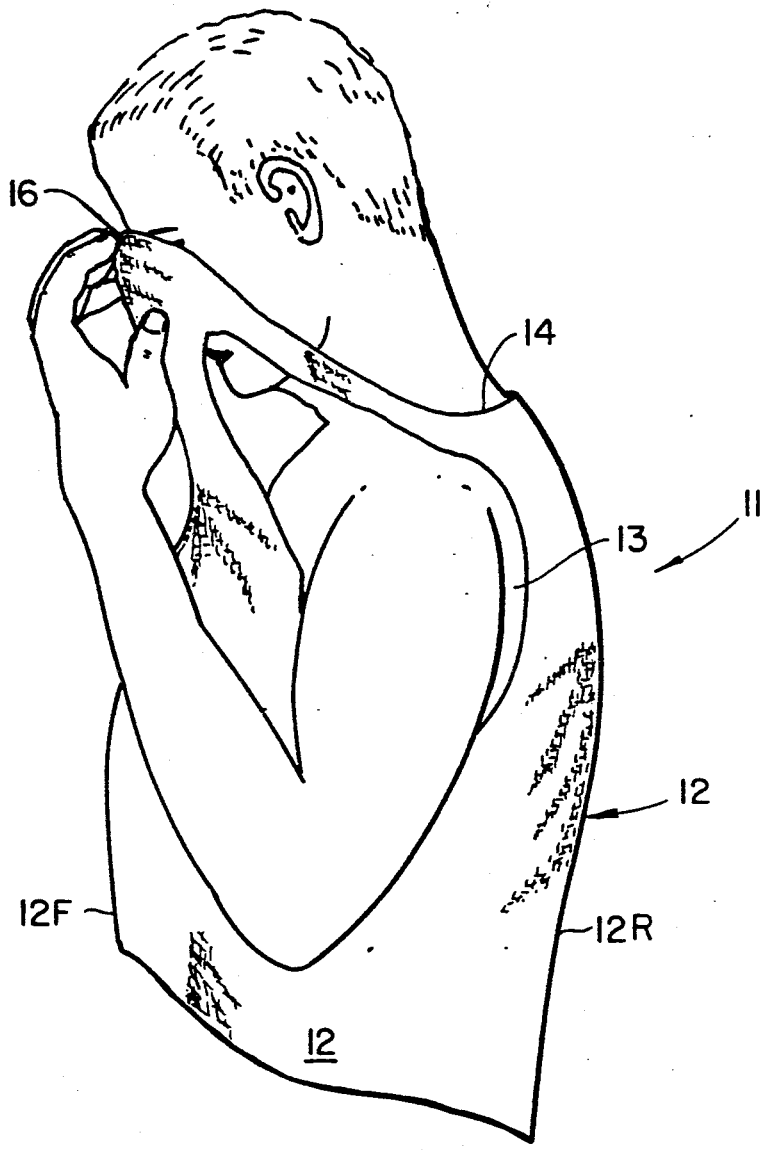
FIG. 1 is a side elevational view showing an athlete wearing a shirt made according to a typical embodiment of the present invention and using a feature thereof to absorb perspiration.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the shirt 11 includes a body portion 12 entirely encircling the torso of the athlete and having two arm openings 13 and a neck opening 14. In this case, with the illustrated tank-top type of shirt, only shoulder straps distinguish the arm openings from the neck opening. This entire body portion may be made of one piece of material or, more likely, may be assembled from several pieces. The material thereof would be primarily a synthetic fabric of comparatively lightweight but strong construction readily receptive to coloring and lettering, and typically hydrophobic. A Spandex-type of material would be quite suitable for this purpose. The body portion would be conventional in all essential respects. However, according to a typical embodiment of the present invention, it is provided with a hydrophilic attachment of a very absorbent material, typically a towel material. In the illustrated embodiment, it is a sheet 16 of light weight cotton flannel and which is fastened to the inside of the front 12F of the shirt by stitching across the shoulder straps as along the line 17 near the top of the arm opening, across the portion 18 of the neck opening at the front, and down the front side of the arm opening at 19 to the bottom of the arm opening at the side of the body, and down the side of the body for a distance of about five or six inches to the lower edge 16L of the sheet 16. The rest of the lower edge of the sheet 16 can be left unattached to the front 12F of the shirt body 12.

In the use of this embodiment of the invention, the shirt is merely pulled up by gripping the front as shown in FIG. 1 for mopping the face with the absorbent sheet. Then the shirt is released and falls into place as the athlete resumes play.

Figure 2:
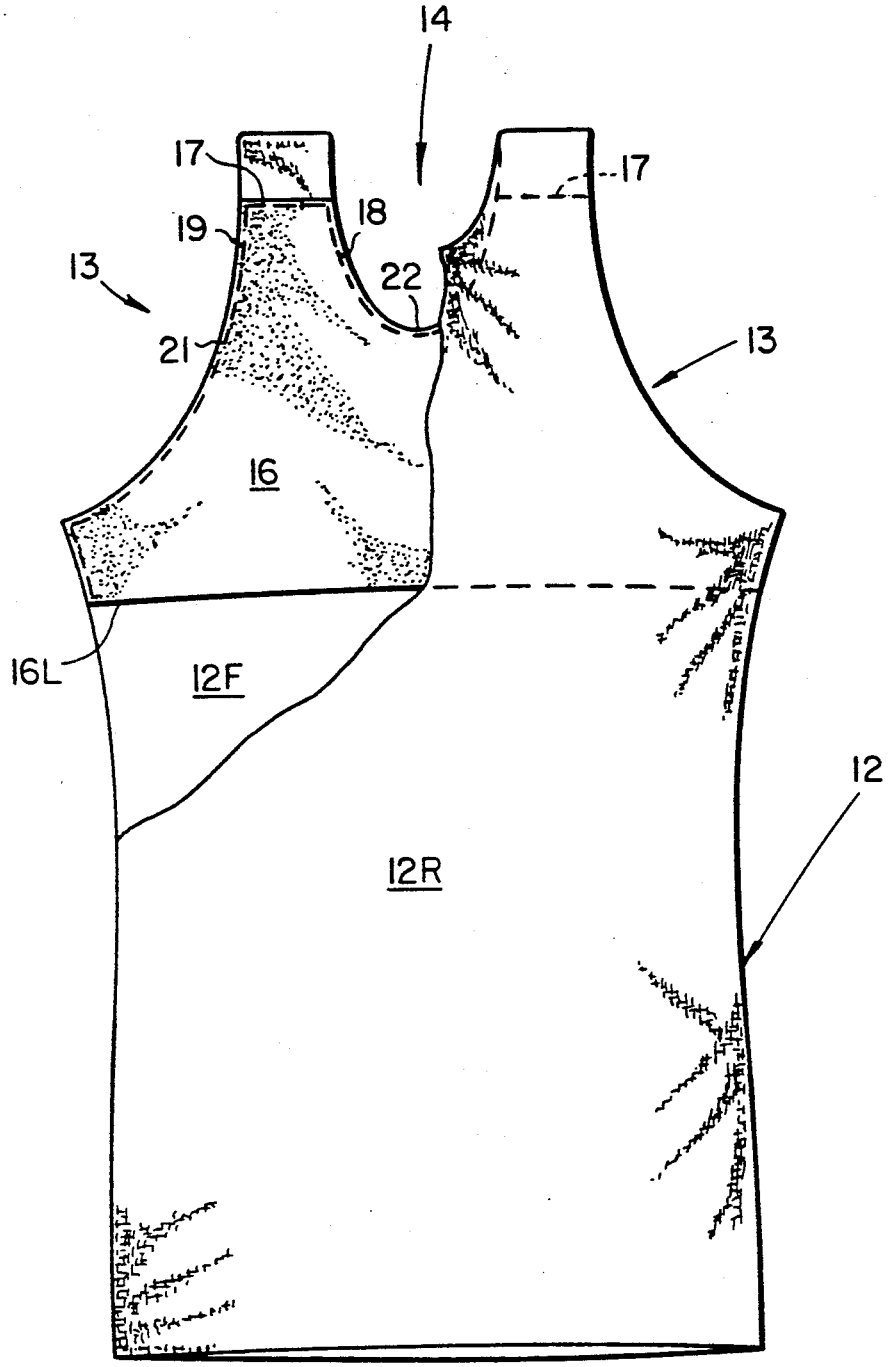
FIG. 2 is a back elevational view with portion cut away to show the interior details.
Figure 3:
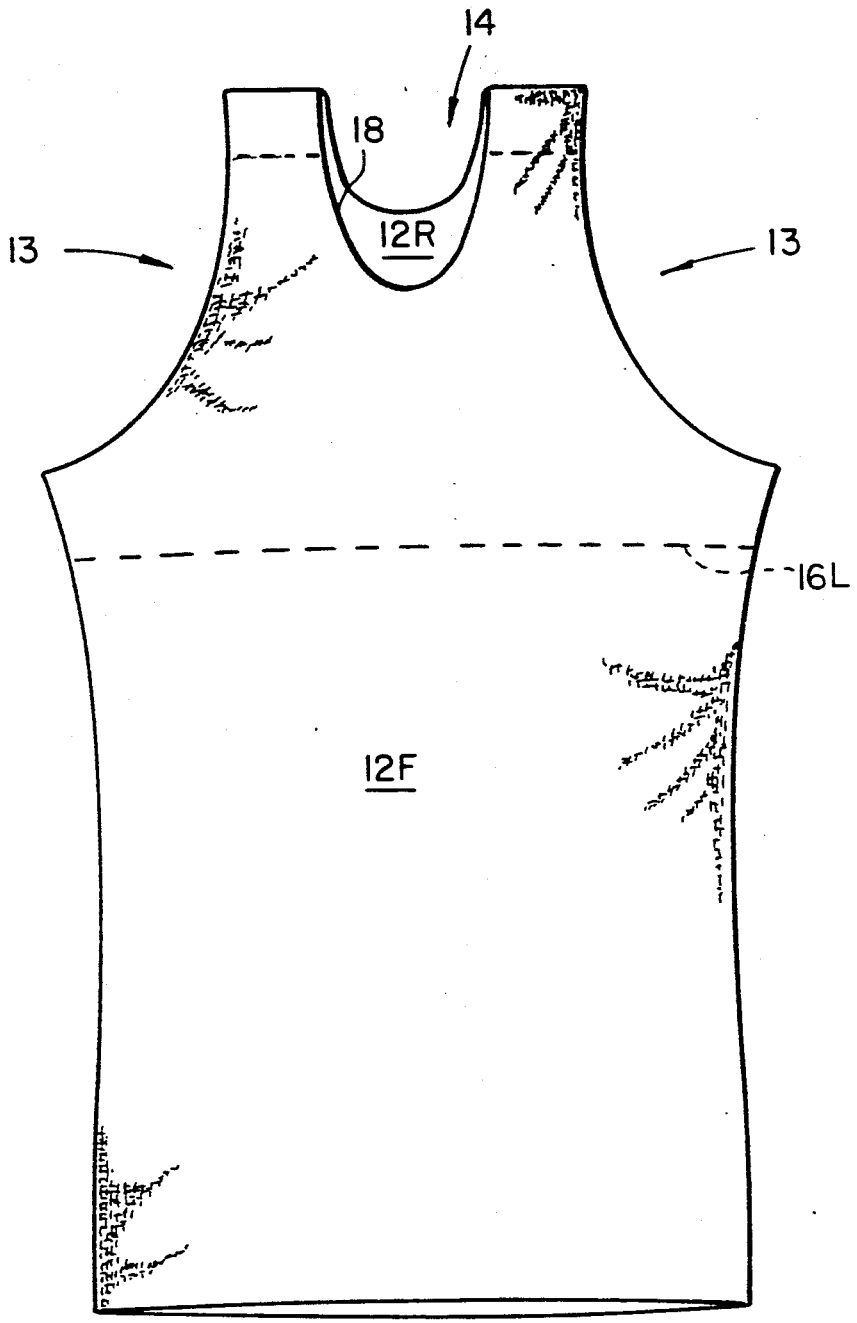
FIG. 3 is a front elevational view thereof.
Figure 4:
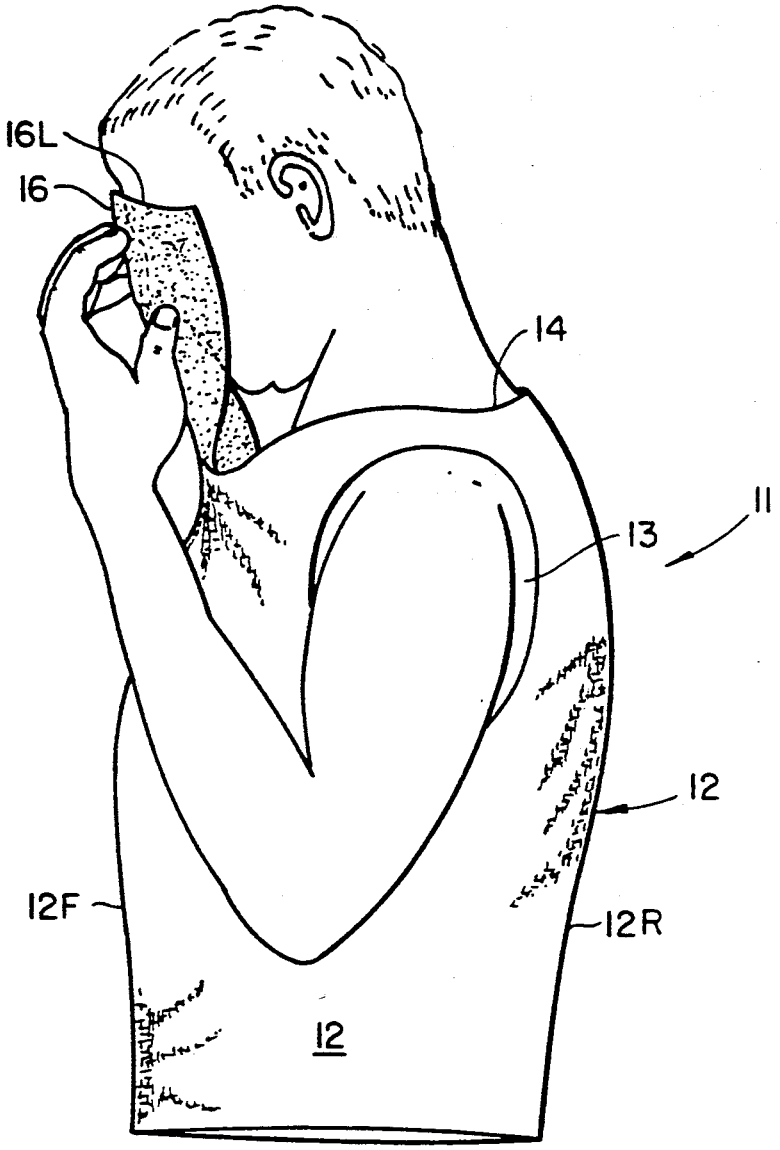
FIG. 4 is a side elevational view showing an athlete wearing a shirt made according to a second embodiment of the present invention and using a pull-out absorbent sheet feature thereof to absorb perspiration.

In the embodiment of FIG. 4, the structure is the same as in the preceding figures, but the sheet 16 is stitched to the front panel 12F down the front side of each arm opening at 19 only to a point such as 21 (FIG. 2) near a level of the bottom 22 of the neck opening at the front. Accordingly, the lower edge 16L of the sheet is free immediately inside the front of the shirt so that the sheet can be pulled out through the neck opening by reaching down inside the shirt and pulling the sheet out to a position where it can be used to wipe the face and brow as shown in FIG. 4. After doing so, it can again be stuffed into the front of the shirt to the position shown in FIGS. 2 and 3, whereupon the athlete can continue to play.

While light weight cotton flannel is an example for the towel sheet 16, a towel of other material such as terry cloth or other heavier and more absorbent material, cloth or paper based, might also be used. While it is believed preferable to have it permanently stitched or otherwise secured to the shirt body, it might be secured by a hook-and-loop fabric fastener, better known as "Velcro" brand fastener, for example.

This invention may be incorporated in shirts of types other than strictly tank top shirts. T-shirts are an example. Also, the shirts in which it can be used are not limited to various sports, but may be used also in other activities and environments where facial perspiration is a problem. Therefore, while the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An athletic shirt comprising:

a tubular body of hydrophobic material and having a front and a rear and having a neck opening and arm openings therein; and a hydrophilic sheet of absorbent material secured to the shirt body adjacent a portion of the neck opening and extending down from the neck and arm openings for a distance to provide an area which can be pulled up for mopping perspiration from the face of the wearer wherein;

the sheet is secured to the shirt body on the inside of the front of the shirt body.

2. The shirt of claim 1 and wherein:

the sheet has an edge portion physically separable from the shirt body and facilitating pulling a substantial portion of the sheet away from the wearer's body for wiping purposes.

3. An athletic shirt comprising the shirt of claim 1 wherein:

the sheet has an edge portion physically separable from the shirt body and facilitating pulling a substantial portion of the sheet away from the wearer's body for wiping purposes; and the substantial portion can be pulled through the neck opening of the shirt body for wiping the wearer's face.

4. The shirt of claim 3 and wherein:

the shirt body is made of synthetic fabric material.

5. The shirt of claim 4 wherein:

the shirt body is made of a Spandex material.

6. The shirt of claim 4 wherein:

the sheet is a towel.

7. The shirt of claim 6 wherein:

the towel is made of a highly absorbent terry cloth or cotton flannel.

8. The shirt of claim 1 wherein:

the sheet is secured to the shirt body around the lower front edge of the neck opening.

9. The shirt of claim 8 wherein:

the sheet is further secured to the shirt body front across openings.

10. An athletic shirt comprising:

a tubular body of hydrophobic material and having a front and a rear and having a neck opening and arm openings therein; and a hydrophilic sheet of absorbent material secured to the shirt body adjacent a portion of the neck opening and extending down from the neck and arm openings for a distance to provide an area which can be pulled up for mopping perspiration from the face of the wearer wherein:

the sheet is secured to the shirt body around the lower front edge of the neck opening; and the sheet is further secured to the shirt body front across the shirt body portions between the neck opening and the arm openings; and the sheet is mounted inside the shirt body.

* * * * *

UNITED STATES PATENT AND TRADEMARK OFFICE

CERTIFICATE OF CORRECTION

PATENT NO. : 5,075,901

DATED : December 31, 1991

INVENTOR(S) : Victor J. Vollrath

It is certified that error appears in the above-identified patent and that said Letters Patent is hereby corrected as shown below:

Column 4, line 9, in Claim 9, after "across" insert:
--the shirt body portions between the neck opening and the arm--.

Signed and Sealed this

Fourth Day of May, 1993

*Attest:*

Michael K. Kirk

MICHAEL K. KIRK

*Attesting Officer*

*Acting Commissioner of Patents and Trademarks*